US009159261B2

(12) United States Patent
Oh

(10) Patent No.: US 9,159,261 B2
(45) Date of Patent: Oct. 13, 2015

(54) METHOD OF GENERATING IMAGE COMPENSATION DATA FOR DISPLAY DEVICE, IMAGE COMPENSATION DEVICE USING THE SAME, AND METHOD OF OPERATING DISPLAY DEVICE

(71) Applicant: SAMSUNG DISPLAY CO., LTD., Yongin, Gyeonggi-Do (KR)

(72) Inventor: Choon-Yul Oh, Seongnam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/221,227

(22) Filed: Mar. 20, 2014

(65) Prior Publication Data

US 2014/0333681 A1 Nov. 13, 2014

(30) Foreign Application Priority Data

May 10, 2013 (KR) ..... 10-2013-0053089

(51) Int. Cl.
*G09G 5/10* (2006.01)
*G09G 3/20* (2006.01)

(52) U.S. Cl.
CPC ..... *G09G 3/2003* (2013.01)

(58) Field of Classification Search
CPC ..... G09G 2320/0233; G09G 2320/0606; G09G 2320/0633; G09G 2320/064; G09G 3/342; G09G 3/001; G09G 3/002; G09G 2360/16; G09G 2320/0646; G09G 3/20; G09G 3/3233; G09G 2300/0842; G09G 2360/144; G09G 3/14; G09G 2320/0242; G09G 2320/043; G09G 2320/0666; G09G 3/3208; G09G 3/12; H04N 13/0055; H04N 13/0059; H04N 13/0239; H04N 13/026; H04N 13/0285; H04N 13/0404; H04N 13/0409; H04N 13/0422; H04N 13/0434; H04N 13/0459; H04N 9/3197
USPC ..... 345/690, 204, 98–102, 60–63, 76–78
See application file for complete search history.

(56) References Cited

U.S. PATENT DOCUMENTS

| | | | | |
|---|---|---|---|---|
| 2008/0111782 | A1* | 5/2008 | Shin et al. | 345/99 |
| 2012/0062609 | A1* | 3/2012 | Jeon | 345/690 |
| 2012/0242680 | A1 | 9/2012 | Park | |
| 2012/0242710 | A1 | 9/2012 | Kang | |

FOREIGN PATENT DOCUMENTS

| | | | |
|---|---|---|---|
| KR | 10-2012-0103942 | A | 9/2012 |
| KR | 10-2012-0108236 | A | 10/2012 |
| KR | 10-2012-0108445 | A | 10/2012 |

* cited by examiner

*Primary Examiner* — Duc Dinh
(74) *Attorney, Agent, or Firm* — Christie, Parker & Hale, LLP

(57) ABSTRACT

A method of generating image compensation data for a display device includes concurrently measuring, by a first image compensation device, first luminance values and first color coordinate values from an image displayed at a display panel in the display device, a number of the first color coordinate values being less than a number of the first luminance values; concurrently generating first luminance data and first color coordinate data associated with the image based on the first luminance values and the first color coordinate values, respectively; and generating first image compensation data for compensating the image based on the first luminance data, the first color coordinate data, a reference luminance value and a reference color coordinate value.

20 Claims, 9 Drawing Sheets

METHOD OF GENERATING IMAGE COMPENSATION DATA FOR DISPLAY DEVICE, IMAGE COMPENSATION DEVICE USING THE SAME, AND METHOD OF OPERATING DISPLAY DEVICE

CROSS-REFERENCE TO RELATED APPLICATION

This application claims priority under 35 USC §119 to and the benefit of Korean Patent Application No. 10-2013-0053089, filed on May 10, 2013 in the Korean Intellectual Property Office (KIPO), the contents of which are herein incorporated by reference in their entirety.

BACKGROUND

1. Field

Example embodiments relate generally to display devices.

2. Description of the Related Art

Generally, a display device generates a data signal having a voltage for each gray level based on a reference gamma voltage, and displays an image corresponding to the generated data signal. Because luminance of the display device may be different from target luminance due to variations that result from manufacturing processes, the display device may compensate the luminance of the display device to correspond to (or achieve) the target luminance. However, if only the luminance is compensated, white balance may be distorted due to the efficiency disparity among red, green, and blue pixels. Therefore, it may be desirable to compensate color coordinate in addition to the luminance.

In a conventional display device, the luminance compensating operation and the color coordinate compensating operation are separately performed, and thus a time for generating image compensation data for the display device may be relatively long.

SUMMARY

Accordingly, the embodiments of the present invention are provided to substantially obviate one or more problems due to limitations and disadvantages of the related art.

Some example embodiments provide a method of generating image compensation data for a display device capable of effectively generating the image compensation data associated with a luminance and a color coordinate compensating operation for the display device.

Some example embodiments provide an image compensation device capable of effectively generating image compensation data associated with a luminance and a color coordinate compensating operation for a display device.

Some example embodiments provide a method of operating a display device capable of performing a luminance and a color coordinate compensating operation for the display device based on image compensation data.

According to example embodiments, provided is a method of generating image compensation data for a display device, the method including concurrently measuring, by a first image compensation device, first luminance values and first color coordinate values from an image displayed at a display panel in the display device, a number of the first color coordinate values being less than a number of the first luminance values; concurrently generating first luminance data and first color coordinate data associated with the image based on the first luminance values and the first color coordinate values, respectively; and generating first image compensation data for compensating the image based on the first luminance data, the first color coordinate data, a reference luminance value and a reference color coordinate value.

The number of the first luminance values may correspond to a number of a plurality of unit pixels in the display panel.

The method may further comprise concurrently measuring, by the first image compensation device, second luminance values and second color coordinate values from the image, the number of the second color coordinate values being less than the number of the second luminance values; and concurrently generating second luminance data and second color coordinate data associated with the image based on the second luminance values and the second color coordinate values, respectively, wherein the first image compensation data is generated based on the first luminance data, the first color coordinate data, the second luminance data, the second color coordinate data, the reference luminance value and the reference color coordinate value.

The display panel may include a first area and a second area. The number of the first luminance values may correspond to a number of a plurality of first unit pixels at the first area of the display panel. The number of the second luminance values may correspond to a number of a plurality of second unit pixels at the second area of the display panel.

The first luminance values and the first color coordinate values may be concurrently measured when the first area of the display panel is turned on. The second luminance values and the second color coordinate values may be concurrently measured when the second area of the display panel is turned on.

The method may further comprise concurrently measuring, by a second image compensation device, second luminance values and second color coordinate values from the image, a number of the second color coordinate values being less than a number of the second luminance values; concurrently generating second luminance data and second color coordinate data associated with the image based on the second luminance values and the second color coordinate values, respectively; and generating second image compensation data for compensating the image based on the second luminance data, the second color coordinate data, the reference luminance value and the reference color coordinate value.

The display panel may comprise a first area and a second area. The number of the first luminance values may correspond to a number of a plurality of first unit pixels at the first area of the display panel. The number of the second luminance values may correspond to a number of a plurality of second unit pixels at the second area of the display panel.

The first luminance values, the first color coordinate values, the second luminance values and the second color coordinate values may be concurrently measured when the first area and the second area of the display panel are concurrently turned on.

According to example embodiments, an image compensation device includes a measuring unit configured to concurrently measure first luminance values and first color coordinate values from an image displayed at a display panel in a display device, a number of the first color coordinate values being less than a number of the first luminance values; a data processor configured to concurrently generate first luminance data and first color coordinate data associated with the image based on the first luminance values and the first color coordinate values, respectively; and a compensation data generator configured to generate first image compensation data for compensating the image based on the first luminance data, the first color coordinate data, a reference luminance value and a reference color coordinate value.

The number of the first luminance values may correspond to a number of a plurality of unit pixels in the display panel.

The measuring unit may be configured to concurrently measure second luminance values and second color coordinate values from the image. The number of the second color coordinate values may be less than the number of the second luminance values. The data processor may be configured to concurrently generate second luminance data and second color coordinate data associated with the image based on the second luminance values and the second color coordinate values, respectively. The first image compensation data may be generated based on the first luminance data, the first color coordinate data, the second luminance data, the second color coordinate data, the reference luminance value and the reference color coordinate value.

The display panel may include a first area and a second area. The number of the first luminance values may correspond to a number of a plurality of first unit pixels at the first area of the display panel. The number of the second luminance values may correspond to a number of a plurality of second unit pixels at the second area of the display panel.

According to example embodiments, provided is a method of operating a display device, the method including: generating first image compensation data for compensating an image displayed at a display panel in the display device; and operating the display panel based on a control signal, input image data and the first image compensation data, wherein generating the first image compensation data includes: concurrently measuring, by a first image compensation device, first luminance values and first color coordinate values from the image, a number of the first color coordinate values being less than a number of the first luminance values; concurrently generating first luminance data and first color coordinate data associated with the image based on the first luminance values and the first color coordinate values, respectively; and generating the first image compensation data based on the first luminance data, the first color coordinate data, a reference luminance value and a reference color coordinate value.

The number of the first luminance values may correspond to a number of a plurality of unit pixels in the display panel.

The generating the first image compensation data may further include: concurrently measuring, by the first image compensation device, second luminance values and second color coordinate values from the image, a number of the second color coordinate values being less than a number of the second luminance values; and concurrently generating second luminance data and second color coordinate data associated with the image based on the second luminance values and the second color coordinate values, wherein the first image compensation data is generated based on the first luminance data, the first color coordinate data, the second luminance data, the second color coordinate data, the reference luminance value and the reference color coordinate value.

The display panel may include a first area and a second area. The number of the first luminance values may correspond to a number of a plurality of first unit pixels at the first area of the display panel. The number of the second luminance values may correspond to a number of a plurality of second unit pixels at the second area of the display panel.

The first luminance values and the first color coordinate values may be concurrently measured when the first area of the display panel is turned on. The second luminance values and the second color coordinate values may be concurrently measured when the second area of the display panel is turned on.

The may further include: generating second image compensation data for compensating the image, wherein generating the second image compensation data includes: concurrently measuring, by a second image compensation device, second luminance values and second color coordinate values from the image, a number of the second color coordinate values being less than a number of the second luminance values; concurrently generating second luminance data and second color coordinate data associated with the image based on the second luminance values and the second color coordinate values; and generating the second image compensation data based on the second luminance data, the second color coordinate data, the reference luminance value and the reference color coordinate value, wherein the display panel operates based on the control signal, the input image data, the first image compensation data and the second image compensation data.

The display panel may include a first area and a second area. The number of the first luminance values may correspond to a number of a plurality of first unit pixels at the first area of the display panel. The number of the second luminance values may correspond to a number of a plurality of second unit pixels at the second area of the display panel.

The first luminance values, the first color coordinate values, the second luminance values and the second color coordinate values may be concurrently measured when the first area and the second area of the display panel are concurrently turned on.

Accordingly, in the method of generating the image compensation data for the display device according to example embodiments, the luminance values and the color coordinate values may be concurrently measured from the image by the image compensation device, and the sampling number for measuring the color coordinate values may be less than the sampling number for measuring the luminance values. As a result, the image compensation data may be rapidly and effectively generated, the image compensation device generating the image compensation data may have a relatively simple structure, and a time for compensating the image based on the image compensation data may be reduced.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Figure 1:
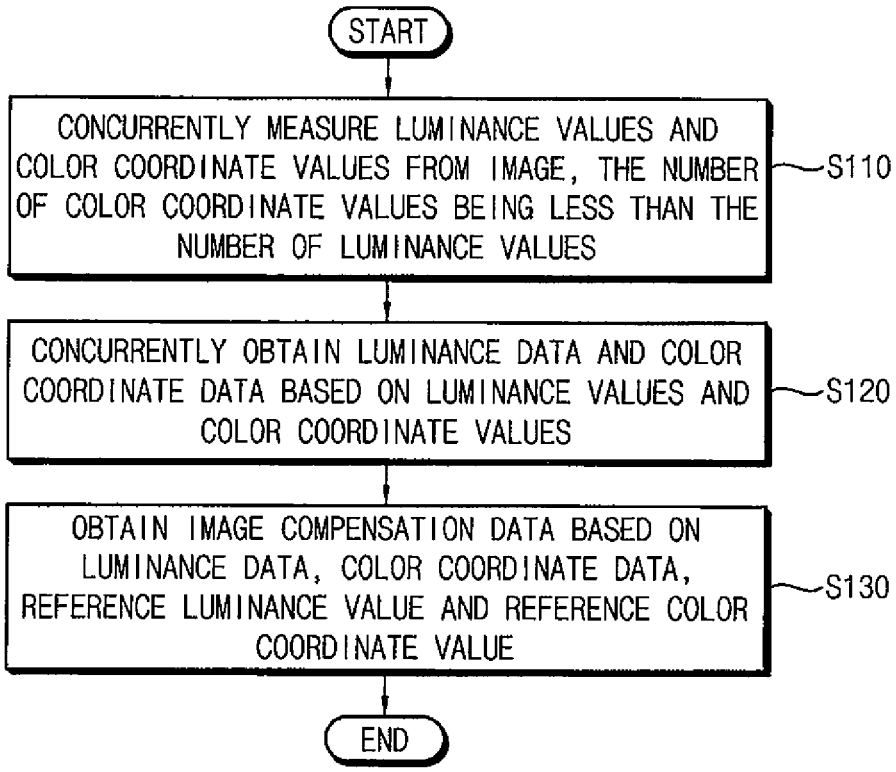
FIG. 1 is a flow chart illustrating a method of generating image compensation data for a display device according to example embodiments.

Various example embodiments will be described more fully with reference to the accompanying drawings, in which embodiments are shown. The present inventive concept may, however, be embodied in many different forms and should not be construed as limited to the embodiments set forth herein. Rather, these embodiments are provided so that this disclosure will be thorough and complete, and will fully convey the scope of the present inventive concept to those skilled in the art. Like reference numerals refer to like elements throughout this application.

It will be understood that, although the terms first, second, etc. may be used herein to describe various elements, these elements should not be limited by these terms. These terms are used to distinguish one element from another. For example, a first element could be termed a second element, and, similarly, a second element could be termed a first element, without departing from the scope of the present inventive concept. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments and is not intended to be limiting of the present inventive concept. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, and/or components.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and should not be interpreted in an idealized or overly formal sense unless expressly so defined herein.

FIG. 1 is a flow chart illustrating a method of generating image compensation data for a display device according to example embodiments.

Referring to FIG. 1, in the method of generating the image compensation data for the display device according to example embodiments, luminance values and color coordinate values (or color characteristic values) are concurrently (e.g., simultaneously) measured from an image by an image compensation device (step S110). For example, the image compensation device may be implemented as a two-dimensional (2D) colorimeter that can concurrently (e.g., simultaneously) measure luminance and color coordinate (or color characteristics). The image may be any image that is displayed on a display panel included in the display device. For example, the image may be a test image for generating the image compensation data.

The number of the color coordinate values is less than the number of the luminance values. In other words, in the method of generating the image compensation data according to example embodiments, the number of sampled (e.g., measured) luminance values may be more than the number of sampled (e.g., measured) color coordinate values. Generally, a uniformity of luminance characteristics is worse than a uniformity of color coordinate characteristics (e.g., a non-uniformity frequency for luminance is higher than a non-uniformity frequency for color coordinate) in display devices, and thus the image compensation data for compensating the image may be effectively generated even if the number of sampled color coordinate values is less than the number of sampled luminance values.

In an example embodiment, the number of the luminance values may correspond to the number of a plurality of unit pixels included in the display panel. For example, the number of the luminance values may be substantially the same as the number of the plurality of unit pixels included in the display panel, and the luminance values may be measured from all of the plurality of unit pixels. As another example, the number of the luminance values may be less than the number of the plurality of unit pixels included in the display panel, and the luminance values may be measured from some of the plurality of unit pixels. As described above, because the number of the color coordinate values is less than the number of the luminance values, the color coordinate values may be measured from some of the plurality of unit pixels.

Luminance data and color coordinate data associated with the image are concurrently (e.g., simultaneously) obtained (or generated) based on the luminance values and the color coordinate values (step S120). For example, when the luminance values are measured from all of the plurality of unit pixels, the luminance data may be obtained (or generated) by combining the measured luminance values. As another example, when the luminance values are measured from some of the plurality of unit pixels, the luminance data may be obtained (or generated) by estimating luminance values for the other unit pixels, which are not used for the measured luminance values, based on an interpolation scheme and by combining the measured luminance values and the estimated luminance values. Similarly, the color coordinate data may be obtained (or generated) by estimating color coordinate values for the other unit pixels, which are not used for the measured color coordinate values, based on the interpolation scheme and by combining the measured color coordinate values and the estimated color coordinate values.

The image compensation data is obtained (or generated) based on the luminance data, the color coordinate data, a reference luminance value and a reference color coordinate value (step S130). For example, first difference data may be obtained (or generated) by comparing the reference luminance value with the luminance data. Second difference data may be obtained (or generated) by comparing the reference color coordinate value with the color coordinate data. The image compensation data may be obtained (or generated) based on the first difference data and the second difference data. The image displayed on the display panel may be compensated based on the image compensation data such that luminance and color coordinate of the compensated image may correspond to the reference luminance value and the reference color coordinate value, respectively, thereby increasing (or improving) the uniformities of luminance and color coordinate characteristics in the display device.

The method of generating the image compensation data according to example embodiments may further include a step of storing the image compensation data in the display device. The image compensation data may be stored in any memory and/or storage unit included in the display device.

In the method of generating the image compensation data for the display device according to example embodiments, the luminance values and the color coordinate values may be concurrently (e.g., simultaneously) measured from the image by the image compensation device, and the sampling number for measuring the color coordinate values may be less than the sampling number for measuring the luminance values. Accordingly, the image compensation data may be rapidly (or quickly) and effectively generated, the image compensation device generating the image compensation data may have a relatively simple structure, and a time for compensating the image based on the image compensation data may be reduced.

Figure 2:
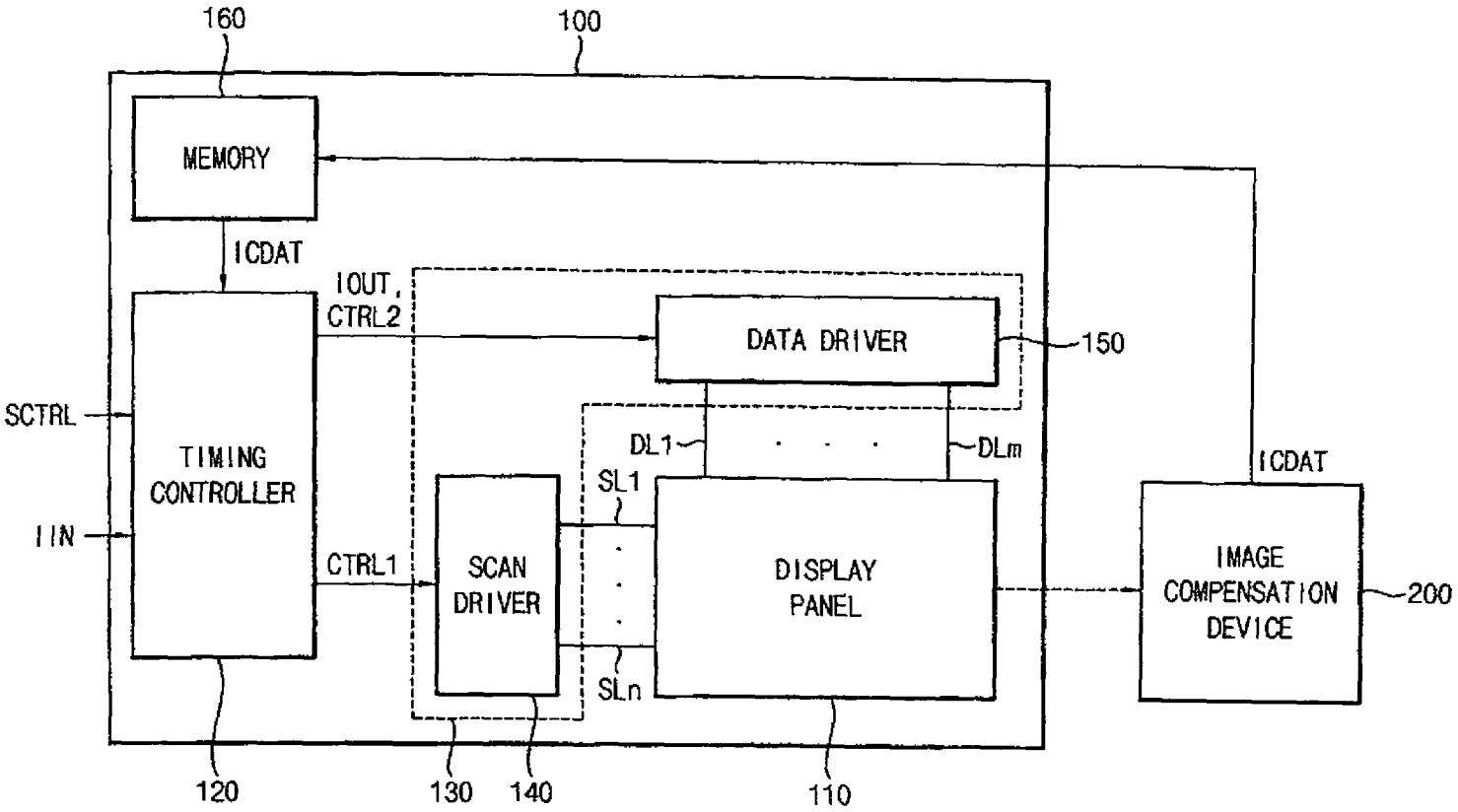
FIG. 2 is a block diagram illustrating an image compensation system including a display device and an image compensation device according to example embodiments.

FIG. 2 is a block diagram illustrating an image compensation system including a display device and an image compensation device according to example embodiments.

Referring to FIG. 2, an image compensation system includes a display device 100 and an image compensation device (or image compensator) 200.

The display device 100 includes a display panel 110, a timing controller 120, a driving unit (or driver) 130 and a memory 160.

The display panel 110 displays images, and is coupled to the driving unit 130 through a plurality of scan lines SL1, . . . , SLn and a plurality of data lines DL1, . . . , DLm. The display panel 110 may include a plurality of unit pixels that are arranged in a matrix form. Each unit pixel may be coupled to crossings of a single scan line and a single data line. For example, the display panel 110 may be any suitable display panel, such as a liquid crystal display (LCD) panel, an organic light emitting diode (OLED) panel, a plasma display panel (PDP), a field emission display (FED) panel, etc.

The timing controller 120 receives a system control signal SCTRL and input image data IIN from a host, and receives image compensation data ICDAT from the image compensation device 200. The timing controller 120 generates a first control signal CTRL1, a second control signal CTRL2 and outputs image data IOUT based on the system control signal SCTRL, the input image data IIN and the image compensation data ICDAT. For example, the system control signal SCTRL may include a vertical synchronization signal, a horizontal synchronization signal, a clock signal, a data enable signal, etc. The first control signal CTRL1 may be a scan driver control signal, and the second control signal CTRL2 may be a data driver control signal. The output image data IOUT may be generated by compensating luminance and color coordinate characteristics of the input image data IIN based on the image compensation data ICDAT.

The driving unit 130 controls an operation of the display panel 110 based on the first and second control signals CTRL1, CTRL2 and the output image data IOUT. The driving unit 130 may include a scan driver 140 and a data driver 150.

The scan driver 140 may be coupled to the display panel 110 through the plurality of scan lines SL1, SLn and may control the operation of the display panel 110 based on the first control signal CTRL1. For example, the scan driver 140 may selectively enable the scan lines SL1, SLn based on the first control signal CTRL1 to select a row of the display panel 110. The data driver 150 may be coupled to the display panel 110 through the plurality of data lines DL1, DLm and may control the operation of the display panel 110 based on the second control signal CTRL2 and the output image data IOUT. For example, the data driver 150 may apply a plurality of driving voltages to the data lines DL1, DLm based on the second control signal CTRL, the output image data IOUT and a gray level voltage provided from a voltage generator. The display panel 110 may display an image corresponding to the output image data IOUT based on such operations of the scan driver 140 and the data driver 150.

The memory 160 may store the image compensation data ICDAT from the image compensation device 200 and may provide the image compensation data ICDAT to the timing controller 120. According to example embodiments, the memory 160 may include at least one volatile memory, e.g., a dynamic random access memory (DRAM), a static random access memory (SRAM), etc., and/or at least one nonvolatile memory, e.g., an erasable programmable read-only memory (EPROM), an electrically erasable programmable read-only memory (EEPROM), a flash memory, a phase change random access memory (PRAM), a resistance random access memory (RRAM), a nano floating gate memory (NFGM), a polymer random access memory (PoRAM), a magnetic random access memory (MRAM), a ferroelectric random access memory (FRAM), etc.

The image compensation device 200 may generate the image compensation data ICDAT for compensating the image displayed on the display panel 110. The image compensation device 200 may operate based on the method shown in FIG. 1.

Figure 3:
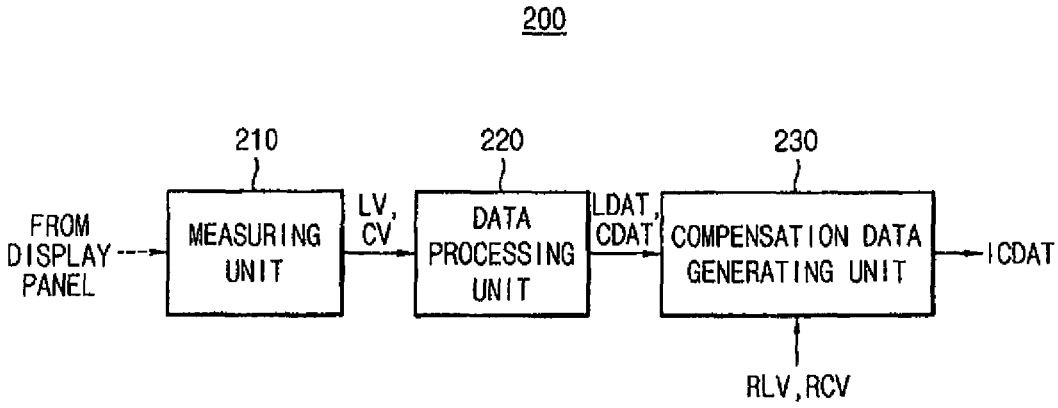
FIG. 3 is a block diagram illustrating an example of the image compensation device shown in FIG. 2.
Figure 4A:
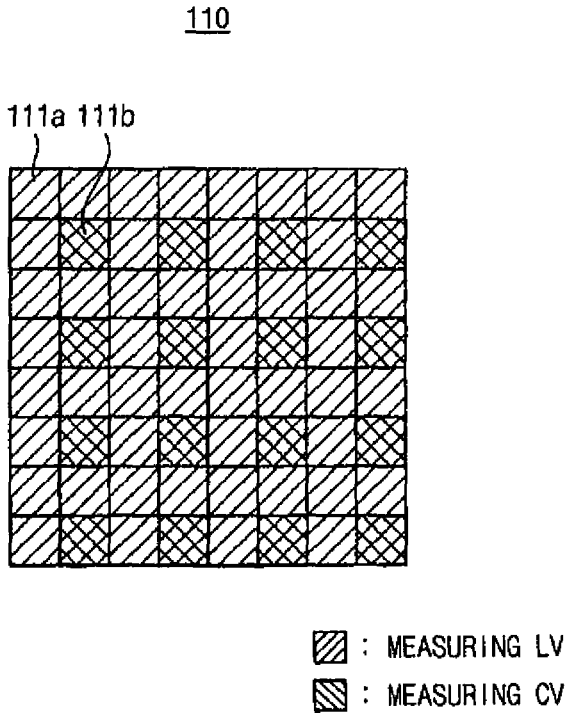
FIGS. 4A and 4B are diagrams for describing an operation of the image compensation device shown in FIG. 3.
Figure 4B:
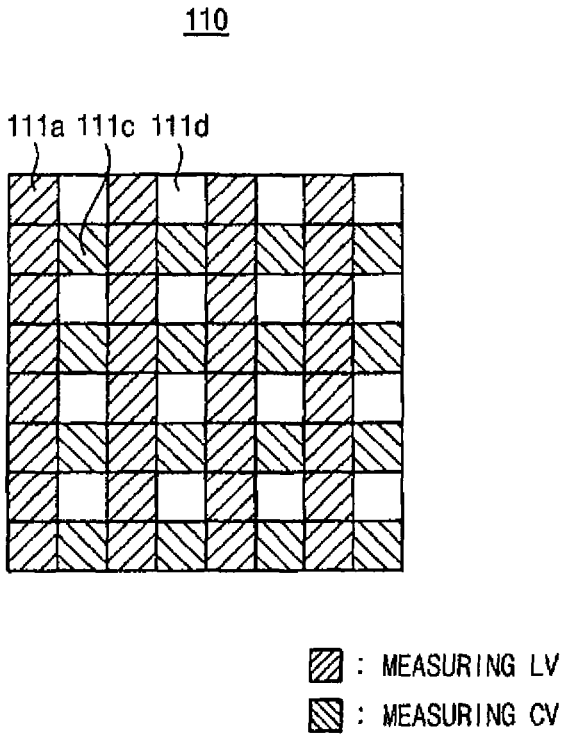

FIG. 3 is a block diagram illustrating an example of the image compensation device shown in FIG. 2. FIGS. 4A and 4B are diagrams for describing an operation of the image compensation device shown in FIG. 3.

Referring to FIGS. 2, 3, 4A and 4B, the image compensation device 200 includes a measuring unit 210, a data processing unit (or data processor) 220 and a compensation data generating unit (or compensation data generator) 230.

The measuring unit 210 concurrently (e.g., simultaneously) measures luminance values LV and color coordinate values CV from the image displayed on the display panel 110. For example, the measuring unit 210 may be implemented with a part of the 2D colorimeter that can concurrently (e.g., simultaneously) measure luminance and color coordinate.

In an example embodiment, the measuring unit 210 may perform the measuring operation based on an example illustrated in FIG. 4A. In more detail, the luminance values LV may be measured from all of the plurality of unit pixels included in the display panel 110, and the color coordinate values CV may be measured from some of the plurality of unit pixels. For example, only a luminance value may be measured from a unit pixel 111*a*, and both luminance and color coordinate values may be measured from a unit pixel 111*b*.

In another example embodiment, the measuring unit 210 may perform the measuring operation according to an example illustrated in FIG. 4B. In more detail, the luminance values LV may be measured from some of the plurality of unit pixels included in the display panel 110, the color coordinate values CV may be measured from some of the plurality of unit pixels, and the number of the unit pixels used for measuring the color coordinate values CV may be less than the number of the unit pixels used for measuring the luminance values LV. For example, only a luminance value may be measured from the unit pixel 111*a*, only a color coordinate value may be measured from a unit pixel 111*c*, and both luminance and color coordinate values may not be measured from a unit pixel 111*d*.

The measuring operation of the measuring unit 210 may be changed. For example, a unit pixel for measuring both luminance and color coordinate values may exist in the example illustrated in FIG. 4B, according to example embodiments.

The data processing unit 220 concurrently (e.g., simultaneously) obtains (or generates) luminance data LDAT and color coordinate data CDAT associated with the image based on the luminance values LV and the color coordinate values CV. For example, the luminance data LDAT may be obtained (or generated) by combining the measured luminance values LV or by combining the measured luminance values LV and estimated luminance values generated based on the interpolation scheme. The color coordinate data CDAT may be obtained (or generated) by combining the measured color coordinate values CV and estimated color coordinate values generated based on the interpolation scheme.

The compensation data generating unit 230 obtains (or generates) image compensation data ICDAT based on the luminance data LDAT, the color coordinate data CDAT, a reference luminance value RLV and a reference color coordinate value RCV. For example, the image compensation data ICDAT may be obtained (or generated) based on luminance differences between the reference luminance value RLV and the luminance data LDAT, and based on color coordinate differences between the reference color coordinate value RCV and the color coordinate data CDAT.

The image compensation device 200 may further include a storage unit that stores the reference luminance value RLV and the reference color coordinate value RCV.

Figure 5:
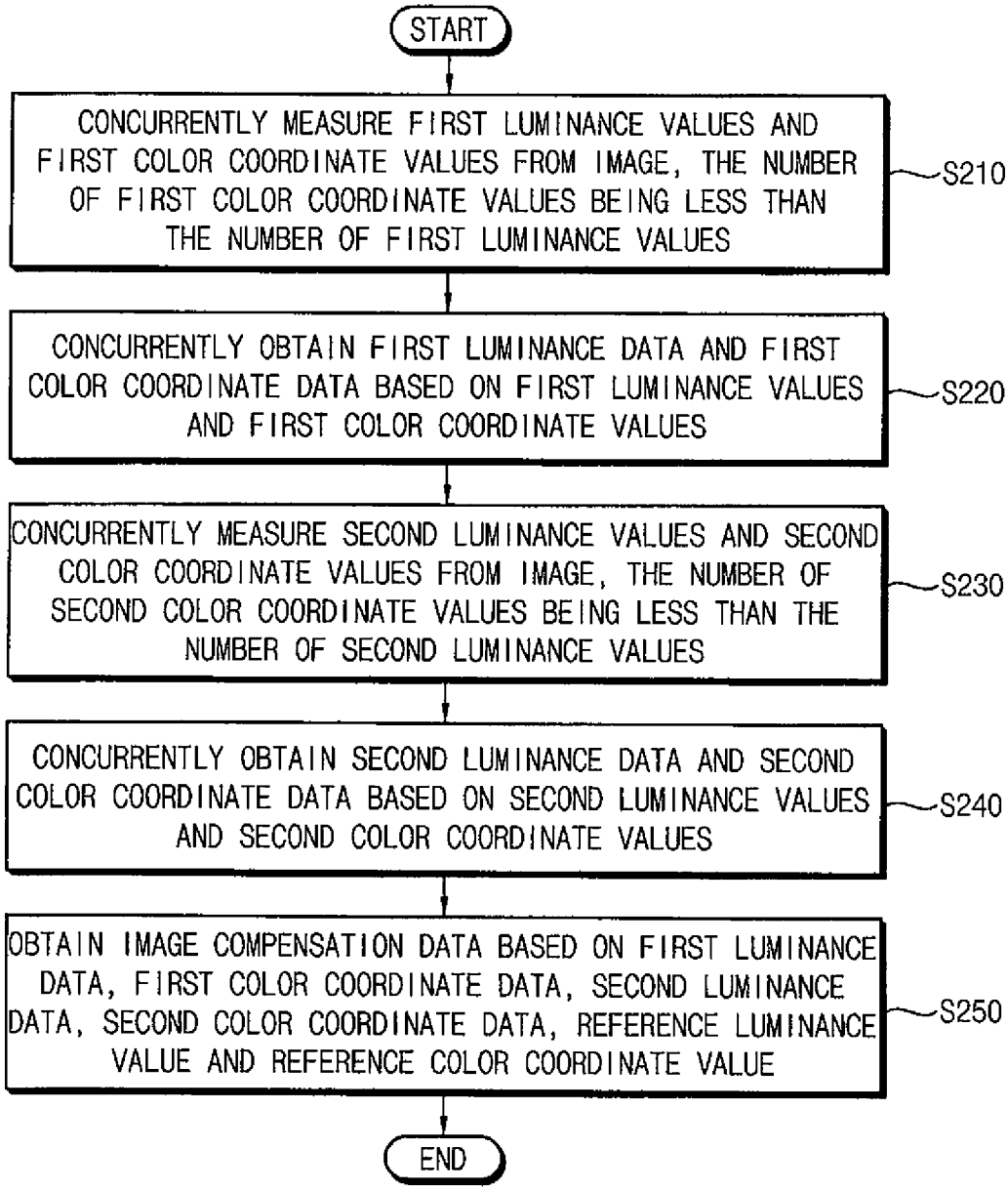
FIG. 5 is a flow chart illustrating a method of generating image compensation data for a display device according to example embodiments.
Figure 6A:
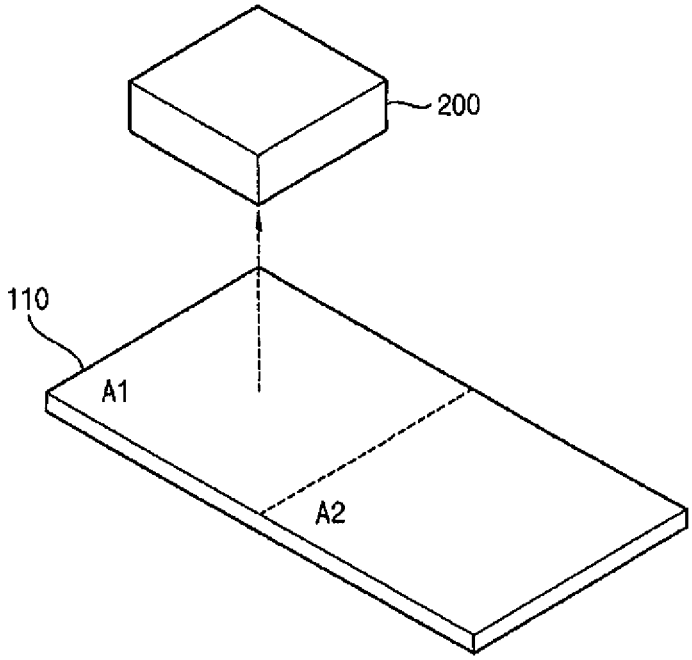
FIGS. 6A and 6B are diagrams for describing the method shown in FIG. 5.
Figure 6B:
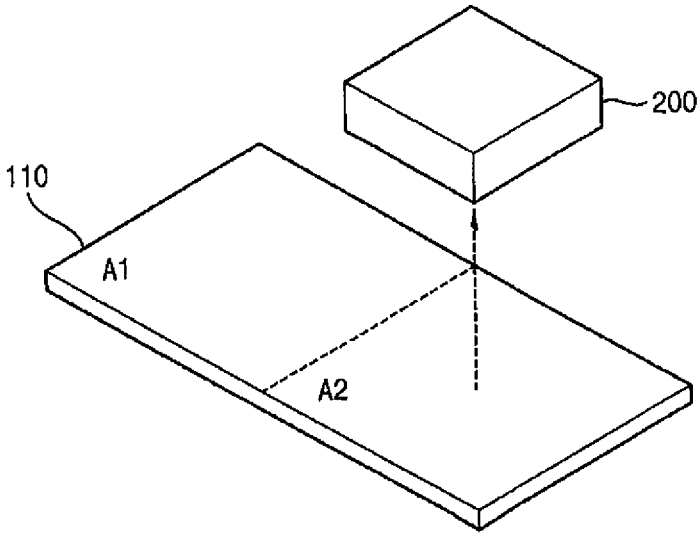

FIG. 5 is a flow chart illustrating a method of generating image compensation data for a display device according to example embodiments. FIGS. 6A and 6B are diagrams for describing the method shown in FIG. 5.

Referring to FIGS. 5, 6A and 6B, in the method of generating the image compensation data for the display device according to example embodiments, first luminance values and first color coordinate values are concurrently (e.g., simultaneously) measured from an image displayed on a display panel 110 by an image compensation device 200 (step S210). First luminance data and first color coordinate data associated with the image are concurrently (e.g., simultaneously) obtained (or generated) based on the first luminance values and the first color coordinate values (step S220). In addition, second luminance values and second color coordinate values are concurrently (e.g., simultaneously) measured from the image by the image compensation device 200 (step S230). Second luminance data and second color coordinate data associated with the image are concurrently (e.g., simultaneously) obtained (or generated) based on the second luminance values and the second color coordinate values (step S240).

The display panel 110 may be divided into a first area A1 and a second area A2. The first luminance values and the first color coordinate values may correspond to the first area A1 of the display panel 110, and the second luminance values and the second color coordinate values may correspond to the second area A2 of the display panel 110. Other than that the measuring operations are performed with respect to a portion of the display panel 110, the steps S210 and S230 may be substantially the same as the step S110 in FIG. 1. Other than that the data obtaining operations (or data generating operations) are performed with respect to a portion of the display panel 110, the steps S220 and S240 may be substantially the same as the step S120 in FIG. 1.

In more detail, the number of the first luminance values may correspond to the number of a plurality of first unit pixels included in the first area A1 of the display panel 110. The number of the first color coordinate values may be less than the number of the first luminance values. The first luminance values may be measured from all or some of the first unit pixels, and the first luminance data may be obtained (or generated) based on the first luminance values by performing the combination and/or interpolation schemes. The first color coordinate values may be measured from some of the first unit pixels, and the first color coordinate data may be obtained (or generated) based on the first color coordinate values by performing the combination and interpolation scheme. Similarly, the number of the second luminance values may correspond to the number of a plurality of second unit pixels included in the second area A2 of the display panel 110. The number of the second color coordinate values may be less than the number of the second luminance values. The second luminance values may be measured from all or some of the second unit pixels, and the second luminance data may be obtained (or generated) based on the second luminance values by performing the combination and/or interpolation schemes. The second color coordinate values may be measured from some of the second unit pixels, and the second color coordinate data may be obtained (or generated) based on the second color coordinate values by performing the combination and interpolation scheme.

If the image compensation device 200 has a relatively low resolution, it may be difficult to generate the image compensation data for the whole area of the display panel 110 based on one compensating operation. Thus, when a resolution of the image compensation device 200 is lower than the number of the unit pixels included in the display panel 110, or when a resolution of the image compensation device 200 is not high enough for covering the whole area of the display panel 110, the display panel 110 may be divided into the first and second areas A1, A2, respectively, and the measuring and data obtaining (or generating) operations may be performed with respect to the divided areas A1, A2, by one image compensation device 200. As a result, a relatively low resolution of the image compensation device 200 may be supplemented (or counteracted) by the performance of two compensating operations.

In an example embodiment, the first and second areas A1, A2 of the display panel 110 may be alternately turned on. For example, only the first area A1 of the display panel 110 may be turned on when the first luminance and color coordinate values are measured (e.g., in the step 210), and only the second area A2 of the display panel 110 may be turned on when the second luminance and color coordinate values are measured (e.g., in the step 230). In another example embodiment, the first and second areas A1, A2 of the display panel 110 may be concurrently (e.g., simultaneously) turned on.

The image compensation data is obtained (or generated) based on the first luminance data, the first color coordinate data, the second luminance data, the second color coordinate data, a reference luminance value and a reference color coordinate value (step S250). For example, the image compensation data for the whole area of the display panel 110 may be obtained (or generated) based on first difference data between the reference luminance value and the first luminance data, second difference data between the reference color coordinate value and the first color coordinate data, third difference data between the reference luminance value and the second luminance data, and fourth difference data between the reference color coordinate value and the second color coordinate data.

The image compensation device 200 that performs the method of generating the image compensation data of FIG. 5 may include a measuring unit, a data processing unit and a compensation data generating unit. The measuring unit may concurrently (e.g., simultaneously) measure the first luminance values and the first color coordinate values, and may further concurrently (e.g., simultaneously) measure the second luminance values and the second color coordinate values. The data processing unit may concurrently (e.g., simultaneously) obtain (or generate) the first luminance data and the first color coordinate data based on the first luminance values and the first color coordinate values, respectively, and may further concurrently (e.g., simultaneously) obtain (or generate) the second luminance data and the second color coordinate data based on the second luminance values and the second color coordinate values, respectively. The compensation data generating unit may obtain (or generate) the image compensation data based on the first luminance data, the first color coordinate data, the second luminance data, the second color coordinate data, the reference luminance value and the reference color coordinate value.

According to example embodiments, the divided areas of the display panel may be changed. The display panel may be divided into k areas, where k is a natural number equal to or greater than two, and the image compensation data for the whole area of the display panel 110 may be generated by performing k compensating operations (e.g., k measuring and data obtaining operations) by one image compensation device. In some embodiments, k measuring operations and i measuring operations, where i is a natural number equal to or less than k, may be performed because the sampling number for measuring the color coordinate values is less than the sampling number for measuring the luminance values.

Figure 7:
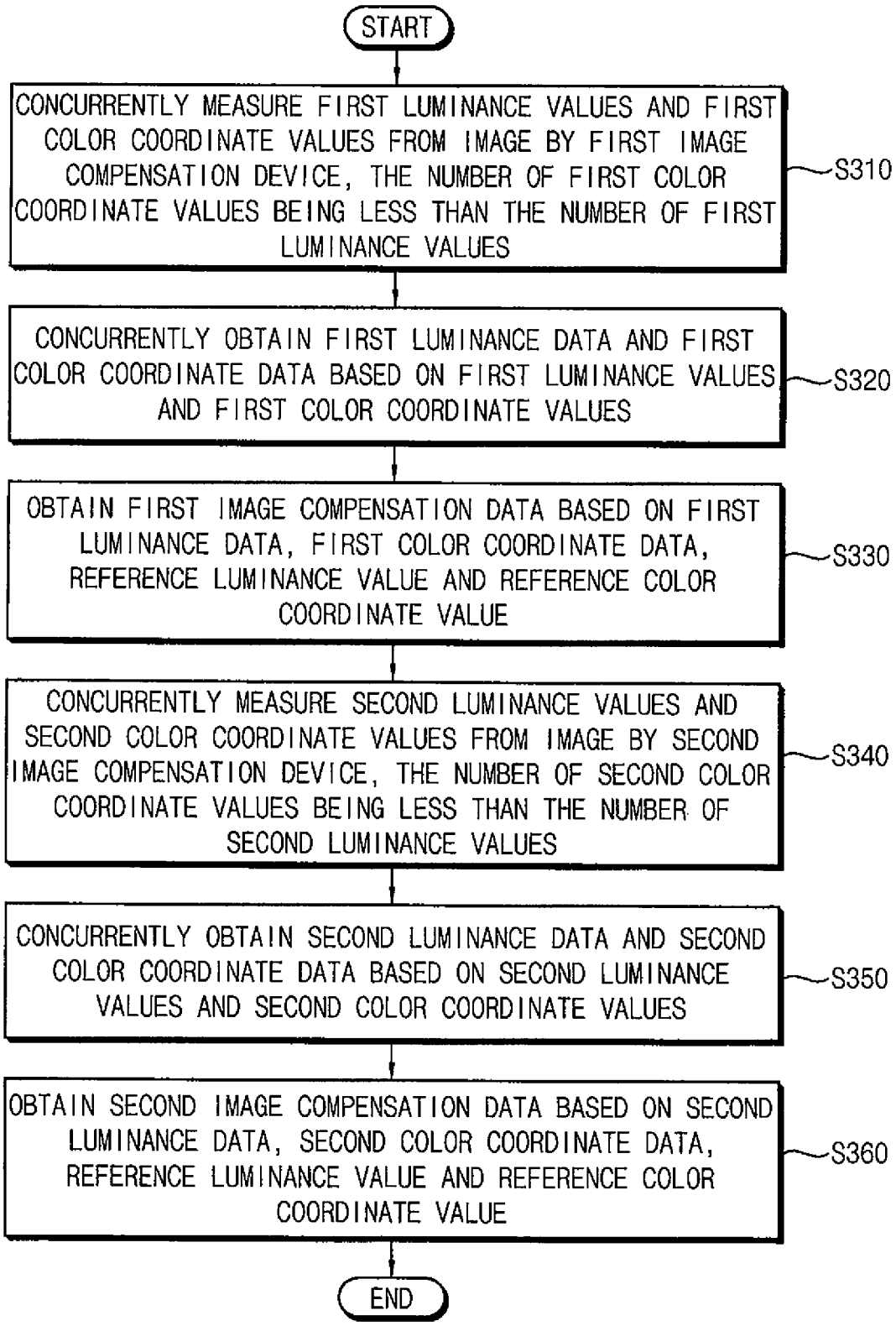
FIG. 7 is a flow chart illustrating a method of generating image compensation data for a display device according to example embodiments.
Figure 8:
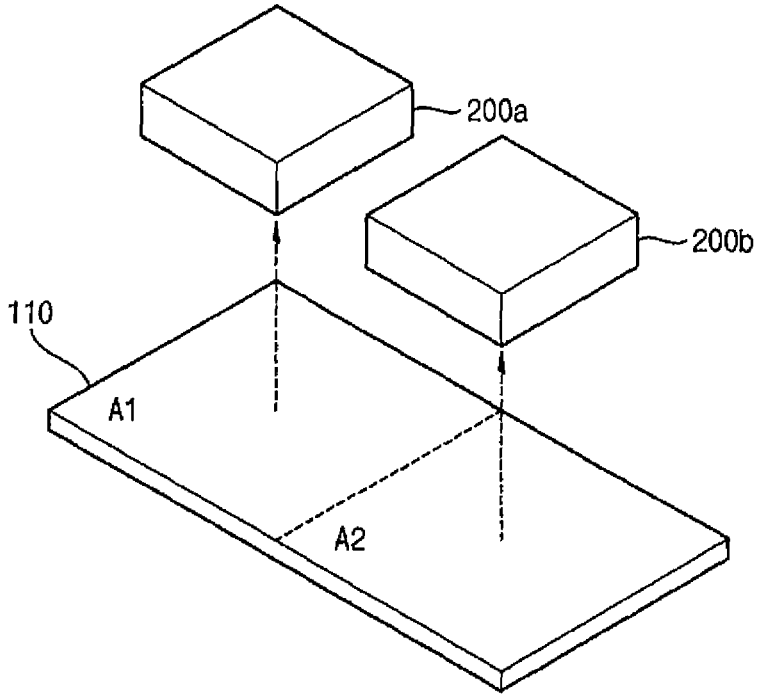
FIG. 8 is a diagram for describing the method shown in FIG. 7.

FIG. 7 is a flow chart illustrating a method of generating image compensation data for a display device according to example embodiments. FIG. 8 is a diagram for describing the method shown in FIG. 7.

Referring to FIGS. 7 and 8, in the method of generating the image compensation data for the display device according to example embodiments, first luminance values and first color coordinate values are concurrently (e.g., simultaneously) measured from an image displayed on a display panel 110 by a first image compensation device 200*a* (step S310). First luminance data and first color coordinate data associated with the image are concurrently (e.g., simultaneously) obtained (or generated) based on the first luminance values and the first color coordinate values (step S320). First image compensation data is obtained (or generated) based on the first luminance data, the first color coordinate data, a reference luminance value and a reference color coordinate value (step S330). In addition, second luminance values and second color coordinate values are concurrently (e.g., simultaneously) measured from the image by a second image compensation device 200*b* (step S340). Second luminance data and second color coordinate data associated with the image are concurrently (e.g., simultaneously) obtained (or generated) based on the second luminance values and the second color coordinate values (step S350). Second image compensation data is obtained (or generated) based on the second luminance data, the second color coordinate data, the reference luminance value and the reference color coordinate value (step S360).

The display panel 110 may be divided into a first area A1 and a second area A2. The first luminance values and the first color coordinate values may correspond to the first area A1 of the display panel 110, and the second luminance values and the second color coordinate values may correspond to the second area A2 of the display panel 110. Other than that the measuring operations are performed with respect to a portion of the display panel 110 and are performed by different image compensation devices 200*a*, 200*b*, the steps S310 and S340 may be substantially the same as the step S110 in FIG. 1. Other than that the data obtaining operations (or data generating operations) are performed with respect to a portion of the display panel 110 and are performed by different image compensation devices 200*a*, 200*b*, the steps S320 and S350 may be substantially the same as the step S120 in FIG. 1, and the steps S330 and S360 may be substantially the same as the step S130 in FIG. 1.

If the image compensation devices 200*a*, 200*b* have relatively low resolutions, it may be difficult to generate the image compensation data for the whole area of the display panel 110 based on one compensating operation. The display panel 110 may be divided into the first and second areas A1, A2, and the measuring and data obtaining (or data generating) operations may be performed with respect to the divided areas A1, A2 by two image compensation devices 200*a*, 200*b*, respectively, and thus the relatively low resolutions of the image compensation devices 200*a*, 200*b* may be supplemented (or counteracted).

In an example embodiment, the first and second areas A1, A2 of the display panel 110 may be concurrently (e.g., simultaneously) turned on, and the first luminance and color coordinate values and the second luminance and color coordinate values may be concurrently (e.g., simultaneously) measured. In another example embodiment, the first and second areas A1, A2 of the display panel 110 may be alternately turned on.

The first image compensation device 200*a* that performs the method of generating the image compensation data of FIG. 7 may include a first measuring unit, a first data processing unit and a first compensation data generating unit. The first measuring unit may concurrently (e.g., simultaneously) measure the first luminance values and the first color coordinate values. The first data processing unit may concurrently (e.g., simultaneously) obtain (or generate) the first luminance data and the first color coordinate data based on the first luminance values and the first color coordinate values. The first compensation data generating unit may obtain (or generate) the first image compensation data based on the first luminance data, the first color coordinate data, the reference luminance value and the reference color coordinate value. The second image compensation device 200*b* that performs the method of generating the image compensation data of FIG. 7 may include a second measuring unit, a second data processing unit and a second compensation data generating unit. The second measuring unit may concurrently (e.g., simultaneously) measure the second luminance values and the second color coordinate values. The second data processing unit may concurrently (e.g., simultaneously) obtain (or generate) the second luminance data and the second color coordinate data based on the second luminance values and the second color coordinate values. The second compensation data generating unit may obtain (or generate) the second image compensation data based on the second luminance data, the second color coordinate data, the reference luminance value and the reference color coordinate value. In this case, the display panel 110 in FIG. 2 may operate based on the system control signal SCTRL, the input image data IIN, the first image compensation data and the second image compensation data.

According to example embodiments, the divided areas of the display panel may be changed. The display panel may be divided into k areas, and k image compensation data for the whole area of the display panel 110 may be generated by performing k compensating operations (e.g., k measuring and data obtaining operations) by k image compensation devices.

Figure 9:
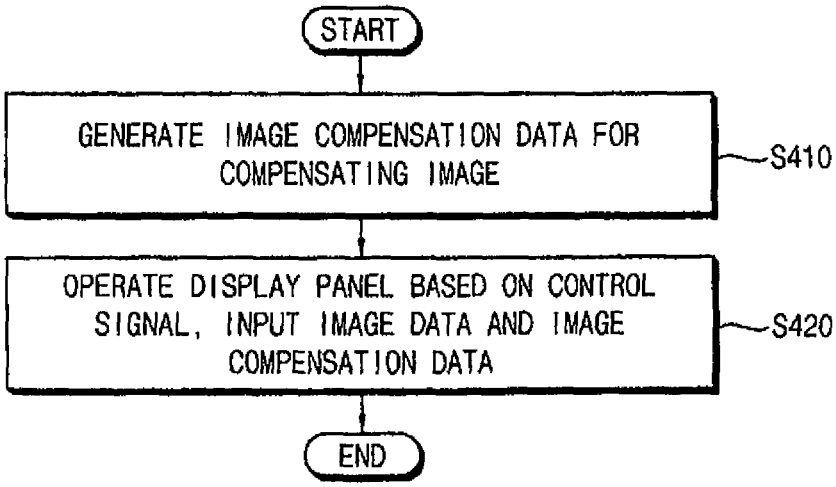
FIG. 9 is a flow chart illustrating a method of operating a display device according to example embodiments.

FIG. 9 is a flow chart illustrating a method of operating a display device according to example embodiments.

Referring to FIGS. 2 and 9, in the method of operating the display according to example embodiments, the image compensation data ICDAT for compensating the image displayed on the display panel 110 is generated (step S410). The display panel 110 operates based on the system control signal SCTRL, the input image data IIN and the image compensation data ICDAT (step S420).

The step S410 may be performed based on the method of generating the image compensation data for the display device according to example embodiments. For example, as illustrated in FIGS. 1, 2 and 3, the luminance values LV and the color coordinate values CV may be concurrently (e.g., simultaneously) measured by the image compensation device 200, the luminance data LDAT and the color coordinate data CDAT may be concurrently (e.g., simultaneously) obtained (or generated) based on the luminance values LV and the color coordinate values CV, and the image compensation data ICDAT may be obtained (or generated) based on the luminance data LDAT, the color coordinate data CDAT, the reference luminance value RLV and the reference color coordinate value RCV. As another example, as illustrated in FIGS. 5, 6A and 6B, the display panel 110 may be divided into k areas, k compensating operations (e.g., k measuring and data obtaining operations) for the k areas may be performed by one image compensation device, and the image compensation data ICDAT may be obtained based on the k compensating operations by the one image compensation device. As another example, as illustrated in FIGS. 7 and 8, the display panel 110 may be divided into k areas, k compensating operations (e.g., k measuring and data obtaining operations) for the k areas may be performed by k image compensation devices, and the image compensation data ICDAT may be obtained (or generated) based on the k compensating operations by the k image compensation devices. Accordingly, the image compensation data may be rapidly (or quickly) and effectively generated, and the time for compensating the image based on the image compensation data may be reduced.

Figure 10:
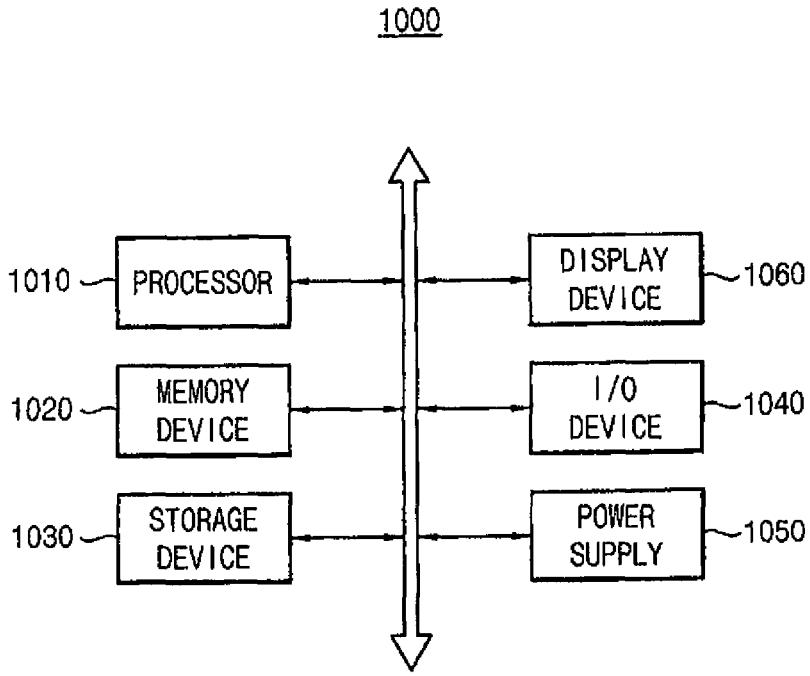
FIG. 10 is a block diagram illustrating a computing system having a display device according to example embodiments.

FIG. 10 is a block diagram illustrating a computing system having a display device according to example embodiments.

Referring to FIG. 10, a computing system 1000 may include a processor 1010, a memory device 1020, a storage device 1030, an input/output (I/O) device 1040, a power supply 1050, and a display device 1060. The computing system 1000 may further include a plurality of ports for communicating with a video card, a sound card, a memory card, a universal serial bus (USB) device, other computing systems, etc.

The processor 1010 may perform various computing functions. The processor 1010 may be a microprocessor, a central processing unit (CPU), etc. The processor 1010 may be coupled to other components via an address bus, a control bus, a data bus, etc. Further, the processor 1010 may be coupled to an extended bus such as a peripheral component interconnection (PCI) bus.

The memory device 1020 may store data for operations of the computing system 1000. For example, the memory device 1020 may include at least one nonvolatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1030 may be a solid state drive (SSD) device, a hard disk drive device, a CD-ROM device, etc. The I/O device 1040 may be an input device such as a keyboard, a keypad, a mouse, a touch screen, etc., and/or an output device such as a printer, a speaker, etc. In some embodiments, the display device 1060 may be included as the output device in the I/O device 1040. The power supply 1050 may provide a power for operations of the computing system 1000. In some example embodiments, the computing system 1000 may further include an application chipset, a camera image processor (CIS), etc.

The display device 1060 may communicate with other components via the buses or other communication links. The display device 1060 may be the display device 100 of FIG. 2. The display device 1060 may receive and may store image compensation data that is rapidly (or quickly) and effectively generated based on one of the methods of FIGS. 1, 5 and 7, and may operate based on the image compensation data and the method of FIG. 9. Accordingly, the time for compensating the image based on the image compensation data may be reduced.

According to example embodiments, the computing system 1000 may be any computing system including the display device 1060, such as a digital television (TV), a 3D TV, a personal computer (PC), a home appliance, a laptop computer, a tablet computer, a mobile phone, a smart phone, a personal digital assistant (PDA), a portable multimedia player (PMP), a digital camera, a music player, a portable game console, a navigation device, etc.

Embodiments of the present invention may be applied to an electronic system having a display device. For example, the embodiments of the present invention may be applied to any display device, such as a liquid crystal display (LCD) device, an organic light emitting display device, a plasma display panel (PDP) device, a field emission display (FED) device, etc., and any computing system including the display device.

The foregoing is illustrative of example embodiments and is not to be construed as limiting thereof. Although a few example embodiments have been described, those skilled in the art will readily appreciate that many modifications are possible to the example embodiments without materially departing from the novel teachings and aspects of embodiments of the present invention. Accordingly, all such modifications are intended to be included within the scope of embodiments of the present invention as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and equivalents thereof.

What is claimed is:

1. A method of generating image compensation data for a display device, the display device comprising a plurality of unit pixels, the method comprising:

concurrently measuring, by a first image compensation device, a first number of first luminance values and a second number of first color coordinate values from an image displayed at a display panel in the display device, wherein the second number is less than the first number, and the first number and the second number respectively correspond to a number of the plurality of unit pixels that are measured;

concurrently generating first luminance data and first color coordinate data associated with the image based on the first luminance values and the first color coordinate values, respectively; and generating first image compensation data for compensating the image based on the first luminance data, the first color coordinate data, a reference luminance value and a reference color coordinate value.

2. The method of claim 1, wherein the first number corresponds to the number of the plurality of unit pixels in the display panel.

3. The method of claim 1, further comprising:

concurrently measuring, by the first image compensation device, second luminance values and second color coordinate values from the image, the number of the second color coordinate values being less than the number of the second luminance values; and concurrently generating second luminance data and second color coordinate data associated with the image based on the second luminance values and the second color coordinate values, respectively, wherein the first image compensation data is generated based on the first luminance data, the first color coordinate data, the second luminance data, the second color coordinate data, the reference luminance value and the reference color coordinate value.

4. The method of claim 3, wherein the display panel comprises a first area and a second area, the first number corresponds to a number of a plurality of first unit pixels at the first area of the display panel, and the second number corresponds to a number of a plurality of second unit pixels at the second area of the display panel.

5. The method of claim 4, wherein the first luminance values and the first color coordinate values are concurrently measured when the first area of the display panel is turned on, and the second luminance values and the second color coordinate values are concurrently measured when the second area of the display panel is turned on.

6. The method of claim 1, further comprising:

concurrently measuring, by a second image compensation device, second luminance values and second color coordinate values from the image, a number of the second color coordinate values being less than a number of the second luminance values;

concurrently generating second luminance data and second color coordinate data associated with the image based on the second luminance values and the second color coordinate values, respectively; and generating second image compensation data for compensating the image based on the second luminance data, the second color coordinate data, the reference luminance value and the reference color coordinate value.

7. The method of claim 6, wherein the display panel comprises a first area and a second area, the number of the first luminance values corresponds to a number of a plurality of first unit pixels at the first area of the display panel, and the number of the second luminance values corresponds to a number of a plurality of second unit pixels at the second area of the display panel.

8. The method of claim 7, wherein the first luminance values, the first color coordinate values, the second luminance values and the second color coordinate values are concurrently measured when the first area and the second area of the display panel are concurrently turned on.

9. An image compensation device comprising:

a measuring unit configured to concurrently measure a first number of first luminance values and a second number of first color coordinate values from an image displayed at a display panel in a display device, the display device comprising a plurality of unit pixels, wherein the second number is less than the first number, and the first number and the second number respectively correspond to a number of the plurality of unit pixels that are measured;

a data processor configured to concurrently generate first luminance data and first color coordinate data associated with the image based on the first luminance values and the first color coordinate values, respectively; and a compensation data generator configured to generate first image compensation data for compensating the image based on the first luminance data, the first color coordinate data, a reference luminance value and a reference color coordinate value.

10. The image compensation device of claim 9, wherein the number of the first luminance values corresponds to the number of the plurality of unit pixels in the display panel.

11. The image compensation device of claim 9, wherein the measuring unit is configured to concurrently measure second luminance values and second color coordinate values from the image, the number of the second color coordinate values being less than the number of the second luminance values, wherein the data processor is configured to concurrently generate second luminance data and second color coordinate data associated with the image based on the second luminance values and the second color coordinate values, respectively, and wherein the first image compensation data is generated based on the first luminance data, the first color coordinate data, the second luminance data, the second color coordinate data, the reference luminance value and the reference color coordinate value.

12. The image compensation device of claim 11, wherein the display panel comprises a first area and a second area, the number of the first luminance values corresponds to a number of a plurality of first unit pixels at the first area of the display panel, the number of the second luminance values corresponds to a number of a plurality of second unit pixels at the second area of the display panel.

13. A method of operating a display device, the display device comprising a plurality of unit pixels, the method comprising:

generating first image compensation data for compensating an image displayed at a display panel in the display device; and operating the display panel based on a control signal, input image data and the first image compensation data, wherein generating the first image compensation data comprises:

concurrently measuring, by a first image compensation device, a first number of first luminance values and a second number of first color coordinate values from the image, wherein the second number is less than the first number, and the first number and the second number respectively correspond to a number of the plurality of unit pixels that are measured;

concurrently generating first luminance data and first color coordinate data associated with the image based on the first luminance values and the first color coordinate values, respectively; and generating the first image compensation data based on the first luminance data, the first color coordinate data, a reference luminance value and a reference color coordinate value.

14. The method of claim 13, wherein the number of the first luminance values corresponds to the number of the plurality of unit pixels in the display panel.

15. The method of claim 13, wherein generating the first image compensation data further comprises:

concurrently measuring, by the first image compensation device, a third number of second luminance values and a fourth number of second color coordinate values from the image, wherein the fourth number is less than the third number;

concurrently generating second luminance data and second color coordinate data associated with the image based on the second luminance values and the second color coordinate values, wherein the first image compensation data is generated based on the first luminance data, the first color coordinate data, the second luminance data, the second color coordinate data, the reference luminance value and the reference color coordinate value.

16. The method of claim 15, wherein the display panel comprises a first area and a second area, the number of the first luminance values corresponds to a number of a plurality of first unit pixels at the first area of the display panel, and the number of the second luminance values corresponds to a number of a plurality of second unit pixels at the second area of the display panel.

17. The method of claim 16, wherein the first luminance values and the first color coordinate values are concurrently measured when the first area of the display panel is turned on, and the second luminance values and the second color coordinate values are concurrently measured when the second area of the display panel is turned on.

18. The method of claim 13, further comprising:

generating second image compensation data for compensating the image, wherein generating the second image compensation data comprises:

concurrently measuring, by a second image compensation device, a third number of second luminance values and a fourth number of second color coordinate values from the image, wherein the fourth number is less than the third number;

concurrently generating second luminance data and second color coordinate data associated with the image based on the second luminance values and the second color coordinate values; and generating the second image compensation data based on the second luminance data, the second color coordinate data, the reference luminance value and the reference color coordinate value, wherein the display panel operates based on the control signal, the input image data, the first image compensation data and the second image compensation data.

19. The method of claim 18, wherein the display panel comprises a first area and a second area, the number of the first luminance values corresponds to a number of a plurality of first unit pixels at the first area of the display panel, and the number of the second luminance values corresponds to a number of a plurality of second unit pixels at the second area of the display panel.

20. The method of claim 19, wherein the first luminance values, the first color coordinate values, the second luminance values and the second color coordinate values are concurrently measured when the first area and the second area of the display panel are concurrently turned on.

* * * * *